US006927350B2

(12) United States Patent
Kondoh et al.

(10) Patent No.: US 6,927,350 B2
(45) Date of Patent: Aug. 9, 2005

(54) MULTI-SUBSTRATE LIQUID METAL HIGH-FREQUENCY SWITCHING DEVICE

(75) Inventors: You Kondoh, Yamato (JP); Tsutomu Takenaka, Hachioji (JP)

(73) Assignee: Agilent Technologies, Inc, Palo Alto, CA (US)

( * ) Notice: Subject to any disclaimer, the term of this patent is extended or adjusted under 35 U.S.C. 154(b) by 51 days.

(21) Appl. No.: 10/738,539

(22) Filed: Dec. 16, 2003

(65) Prior Publication Data

US 2004/0150491 A1 Aug. 5, 2004

(30) Foreign Application Priority Data

Jan. 21, 2003 (JP) ..... 2003-012484

(51) Int. Cl.[7] ..... H01H 29/00
(52) U.S. Cl. ..... 200/182
(58) Field of Search ..... 200/182, 187–189, 200/209–219, 233–236; 310/328, 331, 348, 363; 335/4, 47, 78; 385/19

(56) References Cited

U.S. PATENT DOCUMENTS 6,323,447 B1 11/2001 Kondoh et al.
6,689,976 B1 * 2/2004 Dove et al. ..... 200/182
6,756,552 B2 * 6/2004 Takenaka et al. ..... 200/182
6,781,075 B2 * 8/2004 Dove et al. ..... 200/182
6,806,431 B2 * 10/2004 Kondoh et al. ..... 200/182
6,822,176 B1 * 11/2004 Fazzio ..... 200/182
6,841,746 B2 * 1/2005 Wong et al. ..... 200/182
6,864,767 B2 * 3/2005 Streeter et al. ..... 335/78

FOREIGN PATENT DOCUMENTS

JP 09-161640 6/1997

OTHER PUBLICATIONS

U.S. Appl. No. 10/627,308, filed Jul. 25, 2003, You Kondoh et al.
U.S. Appl. No. 10/173,383, filed Jun. 14, 2002, Marvin G. Wong et al.

* cited by examiner

*Primary Examiner*—Michael A. Friedhofer

(57) ABSTRACT

A device and manufacturing method are provided that comprises forming first and second substrates joined together and comprising a main channel provided in at least one of the substrates and a connecting channel provided in at least one of the substrates, the connecting channel connected to the main channel, and the main channel having spaced apart electrodes and at least partially filled with liquid metal. The method further comprises forming a heater substrate comprising a suspended heater element in fluid communication with the connecting channel, the suspended heater element operable to cause a fluid non-conductor to separate the liquid metal and selectively interconnect the electrodes, and providing a high-frequency signal loss reduction structure between the main channel and the heater substrate.

20 Claims, 5 Drawing Sheets

MULTI-SUBSTRATE LIQUID METAL HIGH-FREQUENCY SWITCHING DEVICE

CROSS-REFERENCE TO RELATED APPLICATIONS

The present application contains subject matter related to a concurrently filed U.S. patent application Ser. No. 10/738,665 by Tsutomu Takenaka and You Kondoh entitled "SURFACE JOINED MULTI-SUBSTRATE LIQUID METAL SWITCHING DEVICE".

BACKGROUND

1. Technical Field

The present invention relates to an electrical device, and more specifically to a liquid metal micro-relay device.

2. Background Art

There are many different types of electrical micro-relay devices, and one popular type is the reed micro-relay, which is a small, mechanical contact type of electrical micro-relay device. A reed micro-relay has two reeds made of a magnetic alloy sealed in an inert gas inside a glass vessel surrounded by an electromagnetic driver coil. When current is not flowing in the coil, the tips of the reeds are biased to break contact and the device is switched off. When current is flowing in the coil, the tips of the reeds attract each other to make contact and the device is switched on.

The reed micro-relay has problems related to large size and relatively short service life. As to the first problem, the reeds not only require a relatively large space, but also do not perform well during high-frequency switching due to their size and electromagnetic response. As to the second problem, the flexing of the reeds due to biasing and attraction causes mechanical fatigue, which can lead to breakage of the reeds after extended use.

In the past, the reeds were tipped with contacts composed of rhodium or tungsten, or were plated with rhodium or gold for conductivity and electrical arcing resistance when making and breaking contact between the reeds. However, these contacts would fail over time. This problem with the contacts has been improved with one type of reed micro-relay called a "wet" relay. In a wet relay, liquid metal, such as mercury, is used to make the contact. This solved the problem of contact failure, but the problem of mechanical fatigue of the reeds remained unsolved.

In an effort to solve these problems, electrical micro-relay devices have been proposed that make use of the liquid metal in a channel between two micro-relay electrodes without the use of reeds. In the liquid metal devices, the liquid metal acts as the contact connecting the two micro-relay electrodes when the device is switched ON. The liquid metal is separated between the two micro-relay electrodes by a fluid non-conductor when the device is switched OFF. The fluid non-conductor is generally high-purity nitrogen or some other such inert gas.

With regard to the size problem, the liquid metal devices afford a reduction in the size of an electrical micro-relay device since reeds are not required. Also, the use of the liquid metal affords longer service life and higher reliability.

The liquid metal devices are generally manufactured by joining together two substrates with a heater in between to heat the gas. The gas expands to separate the liquid metal to open and close a circuit. Previously, the heaters were inline resistors patterned on one of the substrates between the two substrates. The substrates were of materials such as glass, quartz, and gallium arsenide upon which the heater material was deposited and etched. Since only isotropic etching could be used, the heater element would consist of surface wiring. The major drawback of surface wiring is that such wiring has poor high-frequency characteristics, high-connection resistance, and poor thermal transfer to the gas.

More recently, suspended heaters have been developed. A suspended heater refers to a configuration in which the heating elements are positioned so that they can be completely surrounded by the gas.

Problems still exist with these liquid metal devices, which include poor high-frequency characteristics of the electrical path through the liquid metal devices.

The problems still further include problems related to poor impedance matching for high-frequency signals.

Solutions to these problems have been long sought, but prior developments have not taught or suggested any solutions and, thus, solutions to these problems have long eluded those skilled in the art.

DISCLOSURE OF THE INVENTION

The present invention provides a device and manufacturing method that comprises forming first and second substrates joined and comprising a main channel provided in at least one of the substrates and a connecting channel provided in at least one of the substrates, the connecting channel connected to the main channel, and the main channel having spaced apart electrodes and at least partially filled with liquid metal. The method further comprises forming a heater substrate comprising a suspended heater element in fluid communication with the connecting channel, the suspended heater element operable to cause a fluid non-conductor to separate the liquid metal and selectively interconnect the electrodes, and providing a high-frequency signal loss reduction structure between the main channel and the heater substrate.

The present invention provides excellent high-frequency characteristics of the electrical path through the liquid metal devices.

The present invention provides low loss for high-frequency signals.

Certain embodiments of the invention have other advantages in addition to or in place of those mentioned above. The advantages will become apparent from reading the following detailed description when taken with reference to the accompanying drawings.

DETAILED DESCRIPTION OF THE INVENTION

Figure 1:
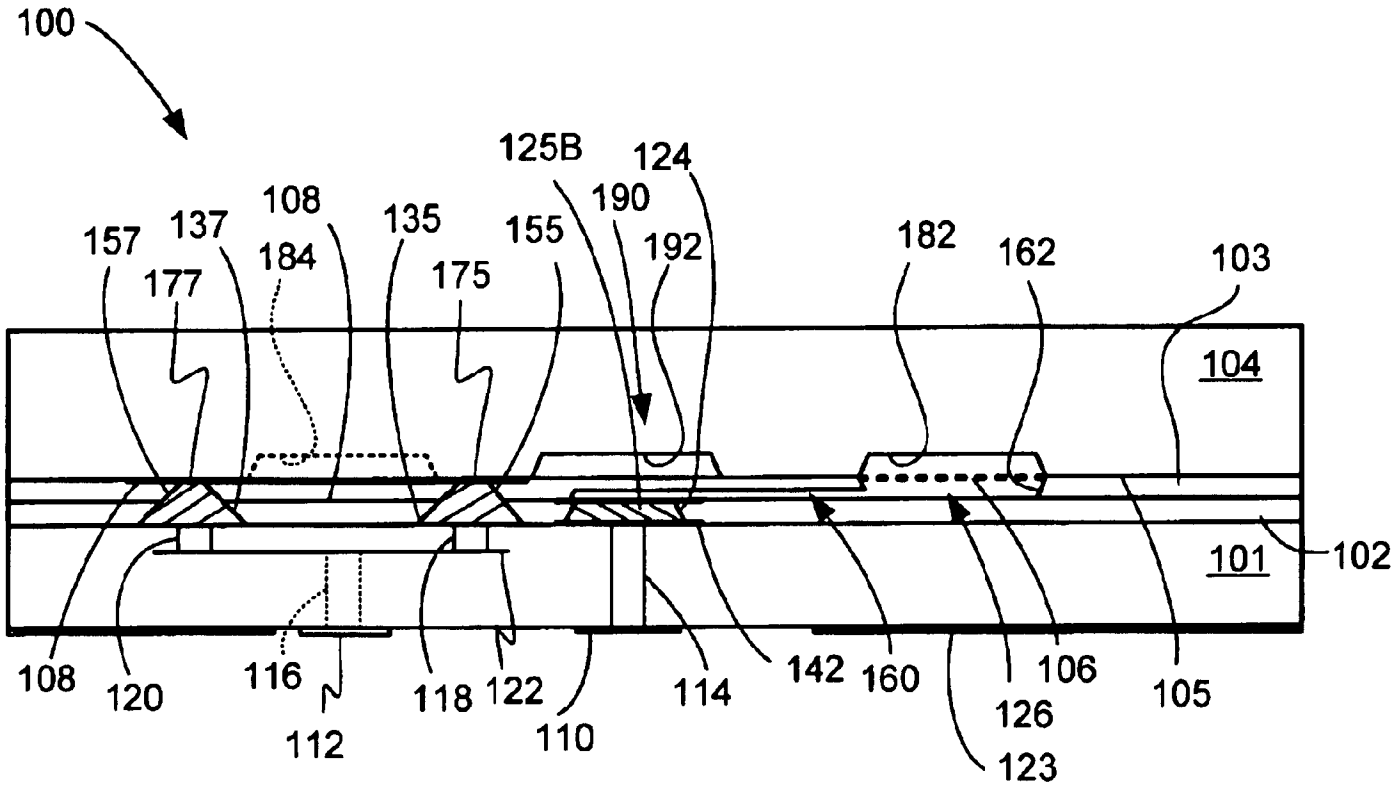
FIG. 1 is a cross-sectional view of the structure of FIG. 2 taken along line 1—1 of a liquid metal micro-relay in accordance with an embodiment of the present invention.

The term "horizontal" as used in herein is defined as a plane parallel to the major surface of a substrate, regardless of its orientation. Terms, such as "top", "bottom", "above", "below", "over", and "under" are defined with respect to the horizontal plane.

In the following description, numerous specific details are given to provide a thorough understanding of the invention. However, it will be apparent that the invention may be practiced without these specific details. In order to avoid obscuring the present invention, some well-known configurations and process steps are not disclosed in detail.

In addition, the drawings showing embodiments of the apparatus are semi-diagrammatic and not to scale and, particularly, some of the dimensions are for the clarity of presentation and may be exaggerated in the drawing FIGs. The same numbers will be used in all the drawing FIGs. to relate to the same elements.

Figure 2:
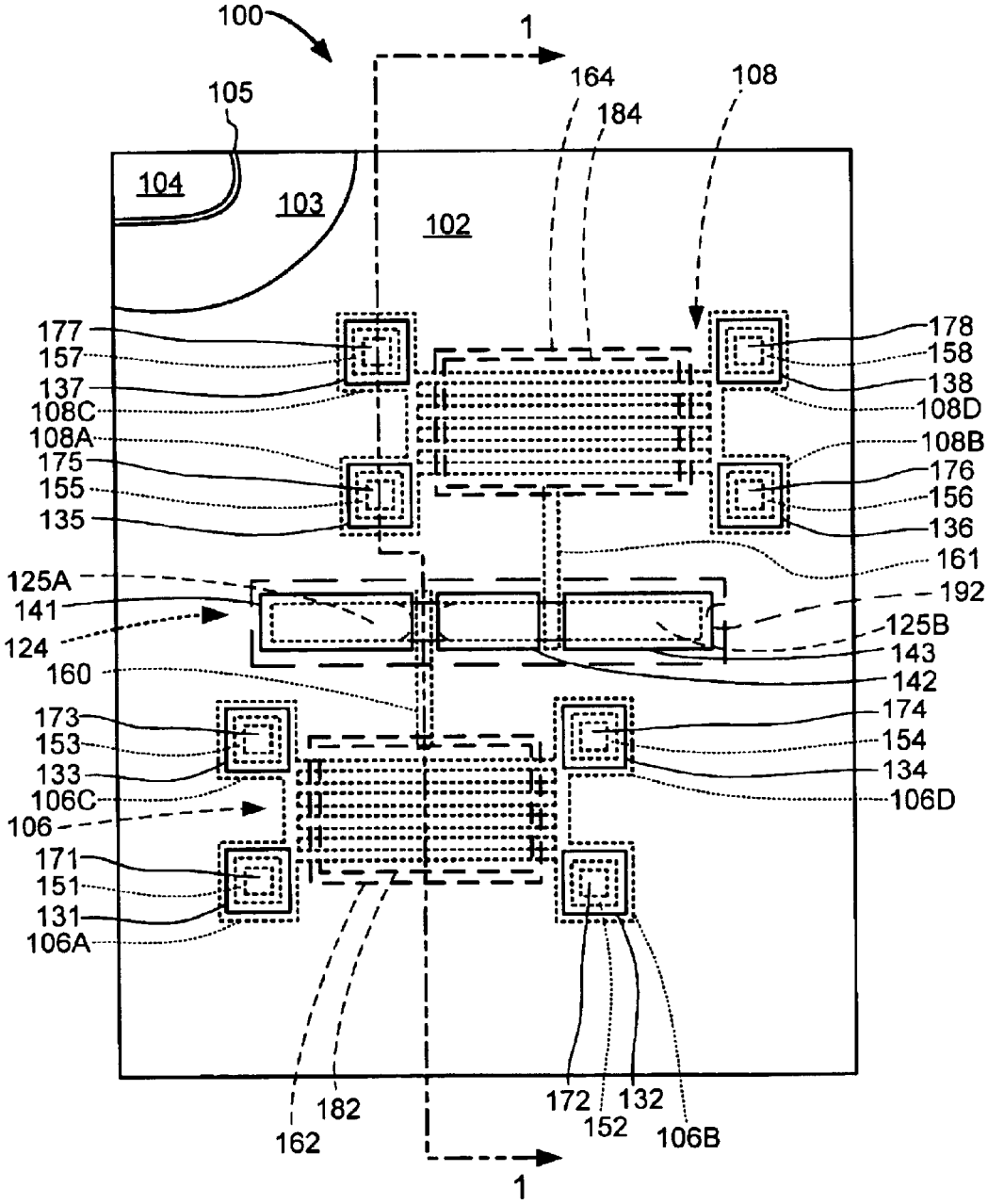
FIG. 2 is a bottom view of a second substrate of the structure of FIG. 1.

Referring now to FIGS. 1 and 2, therein are shown a cross-sectional view of the structure of FIG. 2 taken along line 1—1 of a liquid metal micro-relay 100 and a bottom view of a second substrate of the structure of FIG. 1, both in accordance with an embodiment of the present invention.

The liquid metal micro-relay 100 comprises first, second, third, and heater substrates 101, 102, 103, and 104, respectively. The first and second substrates 101 and 102 are surface joined together; the second and the third substrates 102 and 103 are surface joined; and the third and heater substrate 103 and 104 are surface joined.

The term "surface joined" as used herein is defined as two substrates being joined by a joining technique where their entire flat surface areas, which are capable of being in contact with each other, are bonded by a thin film of material that is planar on both sides. This simultaneously bonds and seals the two substrates. The term "surface joining" refers to a technique for joining, which results in substrates being surface joined. Due to the thinness of the film and the expanse of surface area bonded, the surface joining eliminates the need for special sealing resins to form hermetic bonds or seals in various locations around the surface joined areas. Consequently, the manufacturing process can be simplified, and the cavity volumes of the heaters can be designed more accurately.

The thin film of material is generally an adhesive, such as a resin or an epoxy. Further due to the thinness of the film between the surface joined substrates, an extremely strong bond is formed. The bond is stronger than that provided by the thicker films used in the past.

The different substrates may be manufactured out of different materials, which are not wet by liquid metals. In one embodiment, the first substrate 101 is a finished multilayer structure of ceramic. In manufacturing substrates out of ceramic and glass, unfired materials, i.e., "green" or "raw" ceramics and glasses, are processed to make multilayer structures, which are machined and then fired. These materials have been used because of their mechanical integrity and ability to be incorporated with electrical circuitry. In some cases, they were used because of high-temperature resistance, good high-frequency signal characteristics, or good thermal coefficient properties.

In one embodiment, the respective sizes (length×width×thickness) of the first, second, third, and heater substrates 101, 102, 103, and 104, respectively, are set at 5×5×0.1 mm, 5×5×0.1 mm, 5×5×0.4 mm, and 5×5×0.4 mm.

In another embodiment, the substrates of approximately 100×100 mm are formed, liquid metal filled, and surface joined to manufacture 350 to 400 liquid metal micro-relays 100 in one assembly at one time, and then the assembly is split into individual liquid metal micro-relays 100. This is a method with superior mass production characteristics, and leads to a reduction in the cost of the liquid metal micro-relay 100.

Generally, the second and third substrates 102 and 103 are of glass, which is subject to a patterning process such as sandblasting or etching for forming various openings and channels. Glass and ceramic have relatively low thermal conductivity compared to silicon.

The heater substrate 104 is of single-crystal silicon, which is easily patterned by a process such as etching. In addition, a insulator layer 105 is formed on the surface of the heater substrate 104 surface joined to the second substrate 102 in order to insulate the single-crystal silicon from direct currents in the liquid metal micro-relay 100. The insulator layer 105 is formed by thermal oxidation of the silicon.

First and second suspended heater elements 106 and 108 are formed over the insulator layer 105. In one embodiment, a polysilicon film with a thickness of 100 nm can be used as a suspended heater element; however, it is also possible to use a metal layer or a material such as platinum (Pt), nickel (Ni), or chrome (Cr) as the heating element. In this latter case, it is necessary to coat the metal layer with a material, e.g., silicon oxide ($SiO_2$) or silicon nitride (SiN), that does not react with the vapor of the liquid metal used in the liquid metal micro-relay 100.

The first and second suspended heater elements 106 and 108 are shown as ladder shapes, but they may be mesh shapes, honeycomb shapes, membrane shapes that have no pattern or any other shapes that will allow the passage of a fluid non-conductor through them. The advantage of such suspended heater elements is that the efficiency with which the gas is heated is high, so almost all the heat generated by the suspended heater elements heat the fluid non-conductor.

As shown in FIG. 1, the first substrate 101 has a number of bonding pads represented by bonding pads 110 and 112 on its bottom horizontal surface for connection of electrical wires to the outside world. The bonding pads are electrically conductive and connected to via conductors represented by via conductors 114 and 116 in, and extending at least partially through, the first substrate 101. The via conductors 114 and 116 can be of standard conductor materials such as copper or aluminum, and semiconductor device type vias of tungsten, tantalum, or titanium.

The first substrate 101 further has via conductors represented by via conductors 118 and 120, which also extend partially through the first substrate 101. The via conductors 118 and 120 can be of standard conductor materials such as copper or aluminum, and semiconductor device type vias of tungsten, tantalum, or titanium, or be of liquid metal since they are totally enclosed. However, it has been discovered that better contact connections may be made with other materials such as flexible or anisotropic conductive materials. Examples of flexible conductive materials include combinations of flexible materials such as silicone rubber or fluorosilicone rubber and the like containing conductive flakes of conductive metals, such as copper, gold, aluminum, nickel and the like. Examples of anisotropic conductive materials include carrier materials, such as polyester resin, polyamide resin, polycarbodiimide resin, phenoxy resin, epoxy resin, acrylic resin, saturated polyester resin and the like containing particles of conductive metals, such as copper, gold, aluminum, nickel and the like.

Embedded in the first substrate 101 are conductors represented by a conductor 122, which connects the via conductors as exemplified by the connection of the via conductors 118 and 120 by the conductor 122 to the via conductor 116.

A ground plane 123, which is optional, may be in any position that permits impedance matching for high-frequency signal transmission in the gigahertz range through the liquid metal micro-relay 100. The ground plane 123 allows high-frequency signals to be transmitted with little attenuation or distortion. The ground plane 123 in FIG. 1 is formed on the bottom of the first substrate 101.

The second substrate 102 contains a main channel 124, which contains liquid metal, such as mercury or gallium, or gallium-indium alloys, separated into two parts, liquid metal 125A and liquid metal 125B, by a fluid non-conductor 126, such as high-purity nitrogen or some other such inert gas. The second substrate 102 also has a number of conductor vias 131 through 138, which may be sandblasted to be square, rectangular, round, or some other configuration and filled with liquid metal as the conductor.

The second substrate 102 is provided with electrodes represented by electrodes 141 through 143 for providing electrical connection to the conductor vias represented by the conductor via 114. The electrodes 141 through 143 also provide reduced friction and reduced resistance surfaces for liquid metals 125A and 125B. Similar electrodes (similarly numbered) can be placed on the second substrate 102 above the main channel 124 to provide further reduced friction and reduced resistance surfaces.

The third substrate 103 has a number of conductor vias 151 through 158, which match up with the conductor vias 131 through 138 in the second substrate 102 and which may be sandblasted to be square, rectangular, round, or some other configuration and filled with liquid metal as the conductor. The first and second suspended heater elements 106 and 108 are elongate with a number of conductor pads 106A through 106D and 108A through 108D for allowing balanced, high current flow to the first and second suspended heater elements 106 and 108, respectively.

First and second connecting channels 160 and 161 are formed to be smaller than the main channel 124. This prevents the liquid metals 125A and 125B from entering the first and second connecting channels 160 and 161, but allows the fluid non-conductor 126 to do so.

The third substrate 103 also contains first and second heater chambers 162 and 164 under the heater substrate 104. The second ends of the first and second connecting channels 160 and 161 in the third substrate 103 are positioned to connect the main channel 124 and the first and second heater chambers 162 and 164, respectively.

Liquid metals 171 through 178 are provided in the conductor vias 131 through 138 and 151 through 158 to provide flexible and conforming electrical contacts to first and second suspended heater elements 106 and 108 on the heater substrate 104.

The heater substrate 104 is a single-crystal silicon layer, which allows for the easy formation of suspended heaters. The heater substrate 104 is formed with openings of a first depth that define first and second heater cavities 182 and 184 respectively over the first and second heater chambers 162 and 164 in the third substrate 103. The first suspended heater element 106 is between the first heater cavity 182 and the first heater chamber 162, and the second suspended heater element 108 is between the second heater cavity 184 and the second heater chamber 164. It will be understood that the substrates may be surface joined at different times and in different sequences.

While the single-crystal silicon layer of the heater substrate 104 is easily manufactured, it has a relatively large dielectric loss. When the liquid metal micro-relay 100 is closed and conducting power, the high-frequency characteristics of the electrical path have been found to deteriorate.

More specifically, the high-frequency characteristics of the electrical path deteriorate where the heater substrate 104 is of single-crystal silicon and the ground plane 123 has a width that is greater than the width of the electrical path formed by the electrodes 141–143, and liquid metals 125A and 125B in the main channel 124. The term "electrical path" is used to include the peripheral structural bodies that have an electrical effect on the basic electrical path (i.e., elements that determine the circuit impedance of the basic electrical path). In cases where a dielectric is disposed in the vicinity of the basic electrical path, this dielectric commonly forms a portion of the electrical path. Furthermore, in cases where conductors or ground surfaces are disposed in the vicinity of the basic electrical path, these conductors and ground surfaces commonly form a portion of the electrical path.

More particularly, when liquid metal carries a high-frequency signal, an alternately changing electromagnetic field is induced around the liquid metal. Dielectric materials around the liquid metal slow the changes in the electromagnetic field. The higher the dielectric constant of the material, the greater the slowing, which in turn causes slowing or losses in the high-frequency signal in the liquid metal.

It has been discovered in an embodiment that the deterioration of the high-frequency characteristics can be prevented by surface joining the heater substrate 104 to the third substrate 103 when the third substrate 103 has low dielectric loss in comparison to the single-crystal silicon. Both ceramic and glass provide a low dielectric loss compared to silicon, which has a relatively high dielectric loss.

It has also been discovered in an additional embodiment that incorporating a high-frequency signal loss reduction structure 190 between the liquid metal and the high dielectric loss material will also prevent deterioration of the high-frequency signals.

The high-frequency signal loss reduction structure 190 can be as a high-frequency signal loss reduction cavity 192 in the heater substrate 104 above the position of the main channel 124 and of the electrodes 141, 142, and 143, and liquid metals 125A and 125B in the main channel 124. The high-frequency signal loss reduction cavity 192 should be larger than the main channel 124 by having a length and width in the bottom plane of the heater substrate 104 larger than the length and width of main channel 124 in the top plane of the second substrate 102. The high-frequency signal loss reduction cavity 192 can have about the same depth as the first and second heater cavities 182 and 184 and be formed at the same time using the same processing.

The high-frequency signal loss reduction cavity 192 reduces high-frequency signal losses because it replaces the silicon, which has a high dielectric loss, with free space, which relatively low dielectric loss. The free space of the high-frequency signal reduction cavity 192 can be filled with air or the fluid non-conductor and still have a very low dielectric loss.

Since flat, easily formed substrates are used in the above embodiment, the liquid metal micro-relay 100 is especially adapted for mass production.

In operation, by reference to FIGS. 1, and 2, by passing a current between the conductor pads 106A/C and 106B/D, the first suspended heater element 106 of FIG. 2 is heated causing the gas around the first suspended heater element 106 to expand and move through the first heater chamber 162 and the second connecting channel 160 to cause the liquid metal 125A to separate with a center portion joining with the liquid metal 125B. This opens the conductive connection between the electrodes 141 and 142, and closes the conductive connection between the electrodes 142 and 143.

Conversely, passing a current between the bonding pads 108A/C and 108B/D heats the second suspended heater element 108 of FIG. 2 and causes the liquid metal 125B to be separated to return the liquid metal micro-relay 100 to the position shown in FIG. 1. The surface joining of the first and third substrates 101 and 103 to the second substrate 102 prevents any leakage of the fluid non-conductor 126 out of the liquid metal micro-relay 100 even when heated, and also prevents leakage of atmosphere into the liquid metal micro-relay 100.

Figure 3:
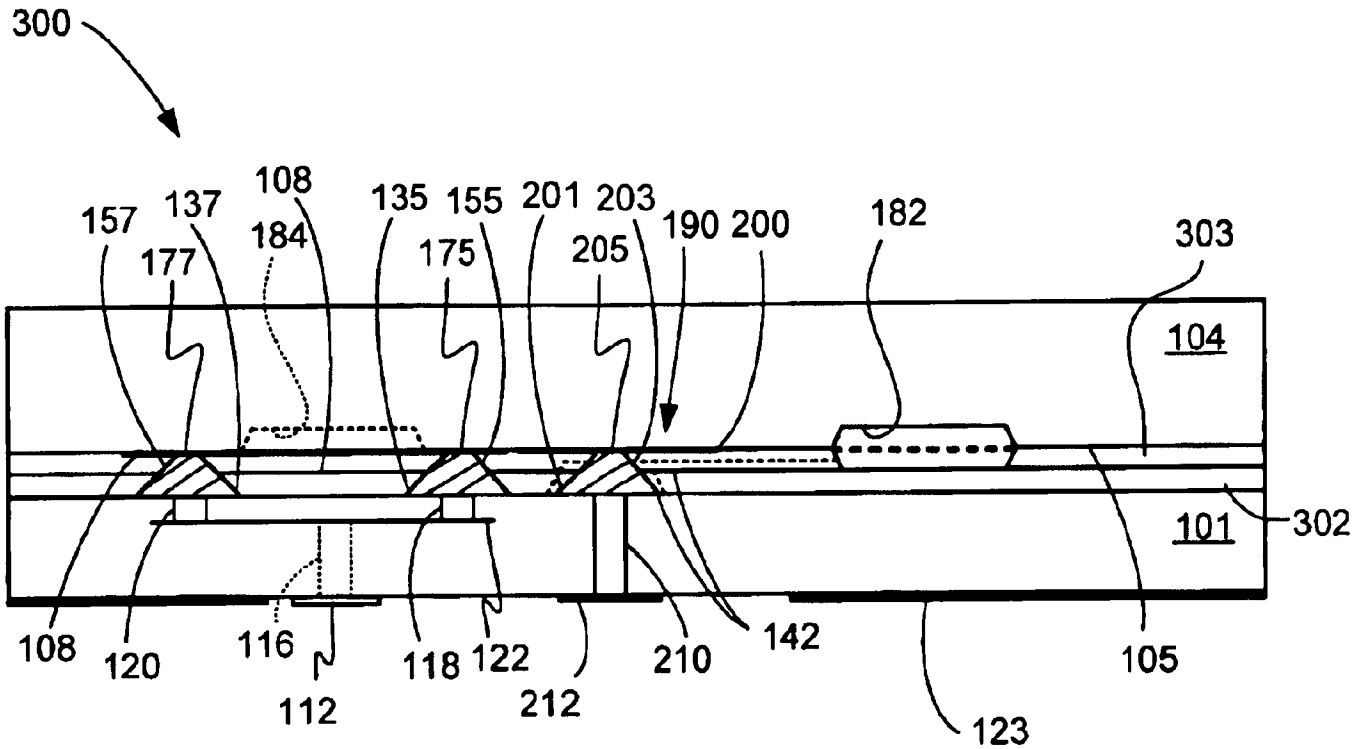
FIG. 3 is a cross-sectional view of the structure of FIG. 4 taken along line 3—3 of a liquid metal micro-relay in accordance with a further embodiment of the present invention.
Figure 4:
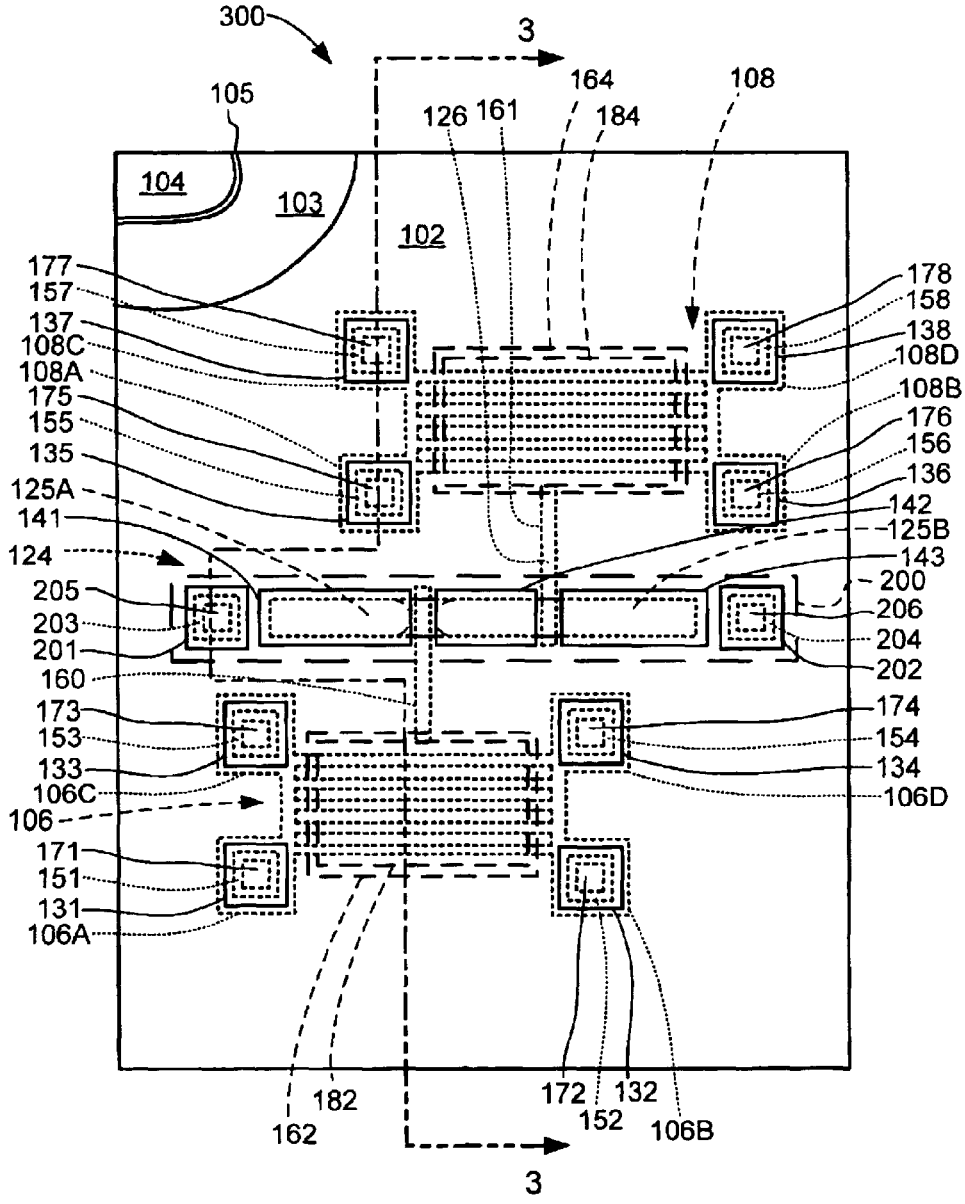
FIG. 4 is a bottom view of a second substrate of the structure of FIG. 3.

Referring now to FIGS. 3 and 4, therein are shown a cross-sectional view of the structure of FIG. 4 taken along line 3—3 of a liquid metal micro-relay 300 and a bottom view of a second substrate of the structure of FIG. 3, both in accordance with a further embodiment of the present invention.

The liquid metal micro-relay 300 comprises first, second, third, and heater substrates 101, 302, 303, and 104, respectively. The first and second substrates 101 and 302 are surface joined together; the second and the third substrates 302 and 303 are surface joined; and the third and heater substrate 303 and 104 are surface joined.

It has been discovered that a high-frequency signal loss reduction structure such as a high-frequency signal loss reduction conductor 200 on the heater substrate 104 above the position of the main channel 124 and of the electrodes 141, 142, and 143, and liquid metals 125A and 125B in the main channel 124 further reduces high-frequency signal losses. The high-frequency signal loss reduction conductor 200 should be larger than the main channel 124 by having a length and width larger than the length and width of the main channel 124 in the top plane of the second substrate 102. The high-frequency signal loss reduction conductor 200 is connectible to a ground or low impedance (not shown).

The high-frequency loss reduction conductor 200 makes it possible to realize superior high-frequency characteristics while maintaining the high-speed switching characteristics that are a special feature of suspended heaters. The electrical contact switching has a low connection resistance when the switch is closed, and also shows little attenuation over a broad band (e.g., from DC to approximately 20 GHz as the frequency band).

The second substrate 302, in addition to the conductor vias 131 through 138, has conductor vias 201 and 202, which may be sandblasted to be square, rectangular, round, or some other configuration and filled with liquid metal as the conductor.

The third substrate 303 has conductor vias 203 and 204, which match up with the conductor vias 201 and 202, respectively, in the second substrate 102 and which may be sandblasted to be square, rectangular, round, or some other configuration and filled with liquid metal as the conductor. The conductor vias 201 and 203 are filled with liquid metal 205 and the conductor vias 202 and 204 are filled with liquid metal 206. It has been found that the conductor vias fit best at each end of the length of the main channel 124 and may be connected to a low impedance through conductor vias filled with liquid metal as represented by the conductor via 210 to conductor pads represented by the conductor pad 212.

As used herein, the term high-frequency loss reduction structure refers to either high-frequency loss reduction cavity and/or conductor formed over the main channel 124, where the high-frequency loss reduction is for high-frequency signals.

The operation of the liquid metal micro-relays 100 and 300 is the same.

The manufacturing of the liquid metal micro-relays 100 and 300 is almost the same except as noted below and provides for easily mass produced devices.

Figure 5:
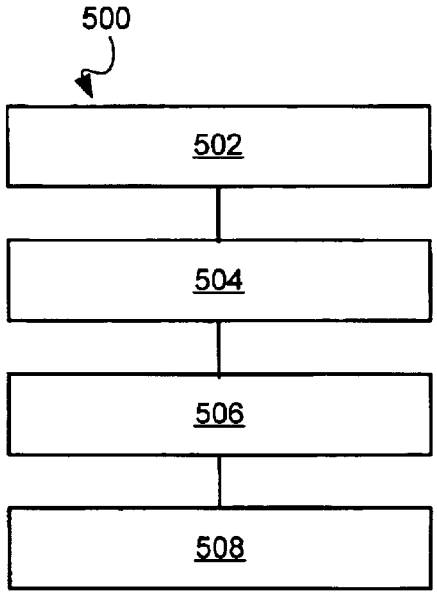
FIG. 5 is a flow chart for the method of manufacturing the present invention.

Referring now to FIG. 5, therein is shown a flow chart for a method 500 of manufacturing the present invention that comprises: a block 502 of forming first and second substrates joined and comprises a main channel provided in at least one of the substrates and a connecting channel provided in at least one of the substrates, the connecting channel connected to the main channel, the main channel having spaced apart electrodes; a block 504 of filling the main channel at least partially with liquid metal; a block 506 of forming a heater substrate comprising a suspended heater element in fluid communication with the connecting channel, the suspended heater element operable to cause a fluid non-conductor to separate the liquid metal and selectively interconnect the electrodes; and a block 508 of providing a high-frequency signal loss reduction structure between the main channel and the heater substrate.

Figure 6:
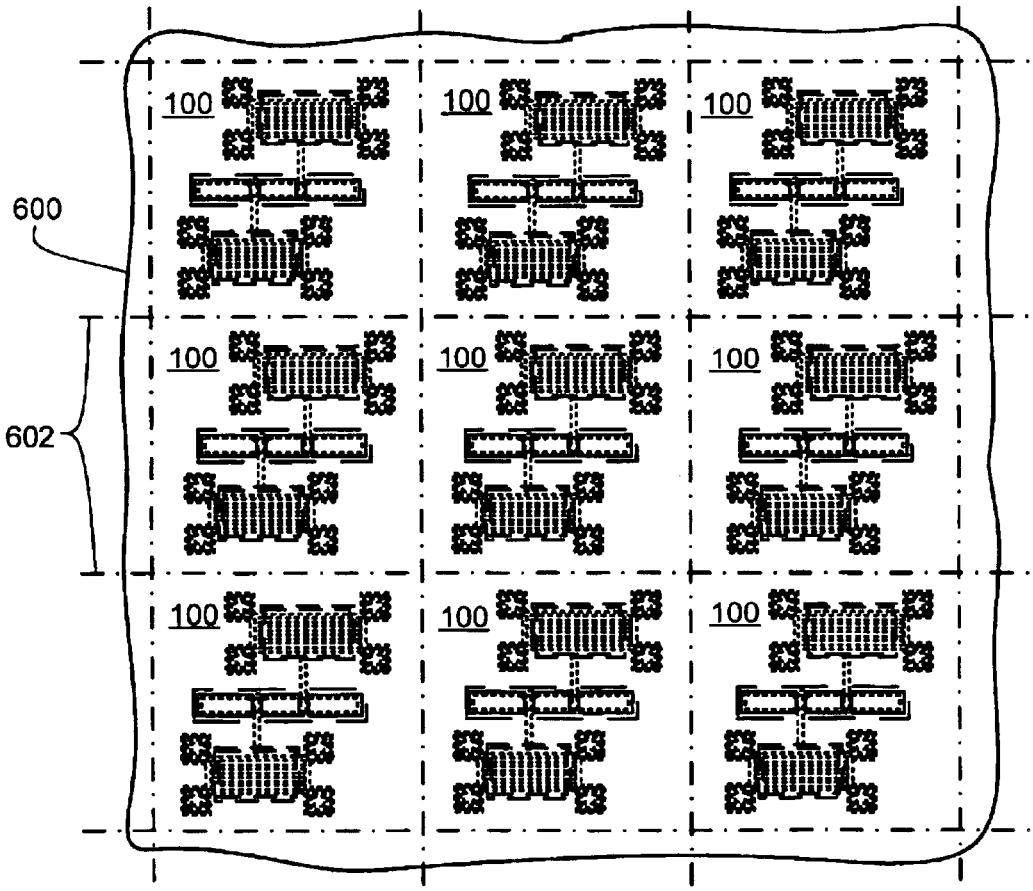
FIG. 6 is a structure of stacked substrates, which contains a large number of liquid metal micro-relays, which are formed prior to singulation.

Referring now to FIG. 6, therein is shown a structure of stacked substrates 600, which contains a large number of liquid metal micro-relays 100, which are formed prior to singulation. The liquid metal micro-relays 100 are completed by a process such as sawing along singulation lines 602, which forms the individual liquid metal micro-relays 100. Thus, the liquid metal micro-relays 100 are suitable for mass production since minimal alignment of the various substrates is required.

While the invention has been described in conjunction with specific embodiments, it is to be understood that many alternatives, modifications, and variations will be apparent to those skilled in the art in light of the foregoing description. Accordingly, it is intended to embrace all such alternatives, modifications, and variations that fall within the scope of the included claims. All matters hithertofore set forth or shown in the accompanying drawings are to be interpreted in an illustrative and non-limiting sense.

The invention claimed is:

1. A method comprising:

forming first and second substrates joined together and comprising a main channel provided in at least one of the substrates and a connecting channel provided in at least one of the substrates, the connecting channel connected to the main channel, the main channel having spaced apart electrodes;

filling the main channel at least partially with liquid metal;

forming a heater substrate comprising a suspended heater element in fluid communication with the connecting channel, the suspended heater element operable to cause a fluid non-conductor to separate the liquid metal and selectively interconnect the electrodes; and providing a high-frequency signal loss reduction structure between the main channel and the heater substrate.

2. The method of claim 1 wherein:

providing the high-frequency signal loss reduction structure comprises providing a third substrate of material having a low dielectric loss compared to the heater substrate; and joining the third substrate to the first, second, and heater substrates.

3. The method of claim 1 wherein:

providing the high-frequency signal loss reduction structure comprises forming a high-frequency signal loss reduction conductor on the heater substrate, the high-frequency signal loss reduction conductor connectable to a low impedance.

4. The method of claim 1 wherein:

providing the high-frequency signal loss reduction structure comprises forming a high-frequency signal loss reduction cavity in the heater substrate.

5. The method of claim 1 additionally comprising:

singulating the first, second, and heater substrates.

6. A method comprising:

forming first, second, and third substrates surface joined together and comprising a main channel provided in at least one of the substrates and a connecting channel provided in at least one of the substrates, the connecting channel connected to the main channel, the main channel having spaced apart electrodes;

filling the main channel at least partially with liquid metal;

forming a heater substrate comprising a suspended heater element in fluid communication with the connecting channel, the suspended heater element operable to cause a fluid non-conductor to separate the liquid metal and selectively interconnect the electrodes; and providing a high-frequency signal loss reduction structure between the heater substrate and the substrate having the main channel provided therein.

7. The method of claim 6 wherein:

forming the third substrate uses material having a low dielectric loss compared to the heater substrate for providing the high-frequency signal loss reduction structure, the third substrate between the second substrate and the heater substrate.

8. The method of claim 6 wherein:

forming the first and second, and third substrates uses material having a lower dielectric loss compared to the heater substrate;

providing the high-frequency signal loss reduction structure comprises forming a high-frequency signal loss reduction conductor larger than the main channel.

9. The method of claim 6 wherein:

forming the first, second, and third substrates uses material having a low dielectric loss compared to the heater substrate; and providing the high-frequency signal loss reduction structure comprises a high-frequency signal loss reduction cavity formed in the heater substrate, the high-frequency signal loss reduction cavity larger than the main channel and of the same depth as the heater cavity.

10. The method of claim 6 additionally comprising:

singulating the first, second, third, and heater substrates.

11. A device comprising:

first and second substrates joined together and comprising a main channel provided in at least one of the substrates and a connecting channel provided in at least one of the substrates, the connecting channel connected to the main channel, the main channel having spaced apart electrodes;

liquid metal at least partially filling the main channel;

a fluid non-conductor in the connecting channel;

a heater substrate joined to one of the substrates and comprising a suspended heater element in fluid communication with the connecting channel, the suspended heater element operable to cause the fluid non-conductor to separate the liquid metal and selectively interconnect the electrodes; and a high-frequency signal loss reduction structure between the heater substrate and the main channel.

12. The device of claim 11 wherein:

the high-frequency signal loss reduction structure comprises a third substrate of material having a low dielectric loss compared to the heater substrate; and the third substrate is joined to the first, second, and heater substrates.

13. The device of claim 11 wherein:

the high-frequency signal loss reduction structure comprises a high-frequency signal loss reduction conductor on the heater substrate, the high-frequency signal loss reduction conductor connectible to a low impedance.

14. The device of claim 11 wherein:

the high-frequency signal loss reduction structure comprises a high-frequency signal loss reduction cavity formed in the heater substrate.

15. The device of claim 11 additionally comprising:

the first, second, and heater substrates joined for singulation.

16. A device comprising:

first, second, and third substrates surface joined together and comprising a main channel provided in at least one of the substrates and a connecting channel provided in at least one of the substrates, the connecting channel connected to the main channel, the main channel having spaced apart electrodes;

liquid metal at least partially filling the main channel;

a non-fluid conductor in the connecting channel;

a heater substrate comprising a suspended heater element in fluid communication with the connecting channel, the suspended heater element operable to cause the fluid non-conductor to separate the liquid metal and selectively interconnect the electrodes; and a high-frequency signal loss reduction structure between the heater substrate and the substrate having the main channel provided therein.

17. The device of claim 16 wherein:

the third substrate comprises material having a low dielectric loss compared to the heater substrate for providing the high-frequency signal loss reduction structure, the third substrate between the second substrate and the heater substrate.

18. The device of claim 16 wherein:

the first and second, and third substrates comprise material providing a lower dielectric loss compared to the heater substrate;

the high-frequency signal loss reduction structure comprises a high-frequency signal loss reduction conductor larger than the main channel.

19. The device of claim 16 wherein:

the first, second, and third substrates comprise material providing a low dielectric loss compared to the heater substrate; and the high-frequency signal loss reduction structure comprises forming a high-frequency signal loss reduction cavity in the heater substrate, the high-frequency signal loss reduction cavity larger than the main channel and of the same depth as the heater cavity.

20. The device of claim 16 additionally comprising:

the first, second, third, and heater substrates surface joined for singulation.

* * * * *